United States Patent [19]

Gray

[11] 4,418,929

[45] Dec. 6, 1983

[54] SINGLE ROLLER SKATE

[76] Inventor: William J. Gray, 4915 S. Braden, #12-E, Tulsa, Okla. 74135

[21] Appl. No.: 371,660

[22] Filed: Apr. 26, 1982

Related U.S. Application Data

[63] Continuation-in-part of Ser. No. 138,236, Apr. 7, 1980, abandoned.

[51] Int. Cl.[3] ..... A63C 17/06

[52] U.S. Cl. ..... 280/11.23; 280/11.2; 280/11.3

[58] Field of Search ..... 280/11.23, 11.26, 11.3, 280/11.36, 11.19, 11.31, 11.32, 11.27, 11.2

[56] References Cited

U.S. PATENT DOCUMENTS

| | | | |
|---|---|---|---|
| 308,744 | 12/1884 | Brix | 280/11.2 |
| 920,848 | 5/1909 | Eubank, Jr. | 280/11.23 |
| 1,017,551 | 2/1912 | Johnson | 280/11.31 |
| 1,529,967 | 3/1925 | Stanley et al. | 280/11.36 |
| 1,672,700 | 6/1928 | Vass | 280/11.31 |
| 1,711,451 | 4/1929 | Gibson | 280/11.28 |
| 2,070,646 | 2/1937 | Blochinger | 280/11.23 |
| 2,100,584 | 11/1937 | Wylie | 280/11.31 |
| 2,679,401 | 5/1954 | Williams | 280/11.3 |
| 2,941,812 | 6/1960 | Reynolds | 280/11.2 |
| 3,993,318 | 11/1976 | Rothmayer | 280/11.26 |
| 4,058,324 | 11/1977 | Dallaire | 280/11.3 |
| 4,072,317 | 2/1978 | Pommereng | 280/11.23 |

FOREIGN PATENT DOCUMENTS

| | | | |
|---|---|---|---|
| 156449 | 11/1904 | Fed. Rep. of Germany | 280/11.36 |
| 893707 | 10/1944 | France | 280/11.36 |

*Primary Examiner*—David M. Mitchell
*Attorney, Agent, or Firm*—Ralph E. Zimmerman

[57] ABSTRACT

A roller skate comprising a platform formed from two aligned plate segments extending downwardly and aligned together to form a channel in an undercarriage support member; the said undercarriage support member having two slots for mounting a pair of roller wheels, front parts of the said platform having attached thereto a slidably adjustable plate, the said adjustable plate having attached thereto a first foot strap useful as a front foot support stabilizer; an adjustable rear bracket mounted on the rear of the said platform having a base and an upper section and a second foot strap on the said rear bracket useful for attaining ankle support structure, a pair of pivot bolts for attaching a leg support device for aiding in the support of the ankle; a pair of bumper stopping cushions located singularly on a bracket on each end of the said undercarriage for fast stopping.

3 Claims, 2 Drawing Figures

SINGLE ROLLER SKATE

This is a continuation in part of Application No. 138,236, filed Apr. 7, 1980 now abandoned.

SINGLE TRACK ROLLER SKATE

The present invention relates solely to roller skates having only two roller wheels in straight alignment, the two roller wheels being mounted in the undercarriage of the main structure of the skate. The majority of skates do not provide structure in which people can wear tennis shoes, and do not have ankle support means while skating. For people to skate on single track roller skates and to be able to develop skating skills heretofore not known requires different skate structure in addition to ankle support means for maneuverability, speed and efficiency on a skating surface.

BACKGROUND OF THE INVENTION

The U.S. Pat. No. to Blochinger, 2,070,646, issued Feb. 16, 1937, shows a single track skate with front and rear braking means 23 and 20, FIG. 2. It has been discovered that to have braking with larger diameter wheels it is necessary to have the brakes mounted on an undercarriage which is lower to the skating surface and below the alignment of the wheel axle for proper braking. This requires an undercarriage as shown in my invention. Such an undercarriage and location of braking means is not shown in the Blochinger patent.

The U.S. Pat. No. to Pommerening, 4,072,317, issued Feb. 7, 1978, shows ankle support means in a single track skate. The difficulty with this skate is that the heel support bracket 8, FIG. 2, is flanged to the outside and is not adjustable to the size of the shoe of the skater. This makes it difficult to skate since the inside pivot 11, FIG. 2, of the ankle support 12 bulges on each side. With this structure it is difficult to maintain proper balance while skating since the protrusion on each leg caused by this structure will lock together in movement of the skater's legs. My invention also has adjustment means, 12, FIG. 1, for sizing the heel support bracket 11, FIG. 1, so that the alignment of the ankle support bracket extensions, 14 and 14', FIG. 1, behind the ankle enables the use of a narrower nonprotruding leg support which will fit closely to the leg, making the ankle support means adjustable as well as adding more ankle support.

The U.S. Pat. No. to Eubank, Jr. 920,848, issued May 4, 1909, discloses a single track skate with an ankle support; a skate somewhat similar to Pommerening which has an improved ankle support structure. Eubank, Jr. like Pommerening teaches the use of an ankle brace with straps to support a show on a skate platform, but like Pommerening, does not teach the innovation of my invention.

OBJECT OF THE INVENTION

The main object of this invention is to provide the public with a set of single track roller skates which will let the skater maneuver more freely and stop quickly and easier by using adjustable back braking.

Another object of this invention is to disclose an improved ankle support attached to the skate which is positioned and anchored to a heel support bracket behind the pivot point of the rear roller wheel so as to give better balance and control to the skater.

Another object of this invention is to mount the roller wheels in an undercarriage for rigid strength in all directions and to better balance the skater for skate maneuvering on the skating surface.

Still another object of this invention is to provide stopping means on the undercarriage of the skate to prevent skater from falling backward.

SUMMARY OF THE INVENTION

The single track roller skate which I shall disclose is novel in structure including certain new and useful improvements. The skate is structured with an undercarriage extending downwardly from two aligned plates which form a platform; the undercarriage being integral with adjustable sole and adjustable heel mounting support means. The undercarriage forms a cradle for a pair of single track wheels and a mounting position for a front and a rear brake. The undercarriage extends upwardly to form a surface with slotted means suitable for mounting a foot support and stabilizer and second, an adjustable heel support and stabilizer to which is attached strap means for fastening a shoe in place. The heel support is a bracket in form of a box enclosure open on one end which is slidably mounted to the two plate segments forming a platform to support the front foot support and the rear heel support which is in form of a bracket.

The adjustable bracket for holding the heel in place and helping to support the ankle is extended upwardly to form an additional support for the ankle. The undercarriage structural design is such that the skate will be lighter in weight making skating easier with less fatigue.

DESCRIPTION OF THE PREFERRED EMBODIMENT

Figure 1:
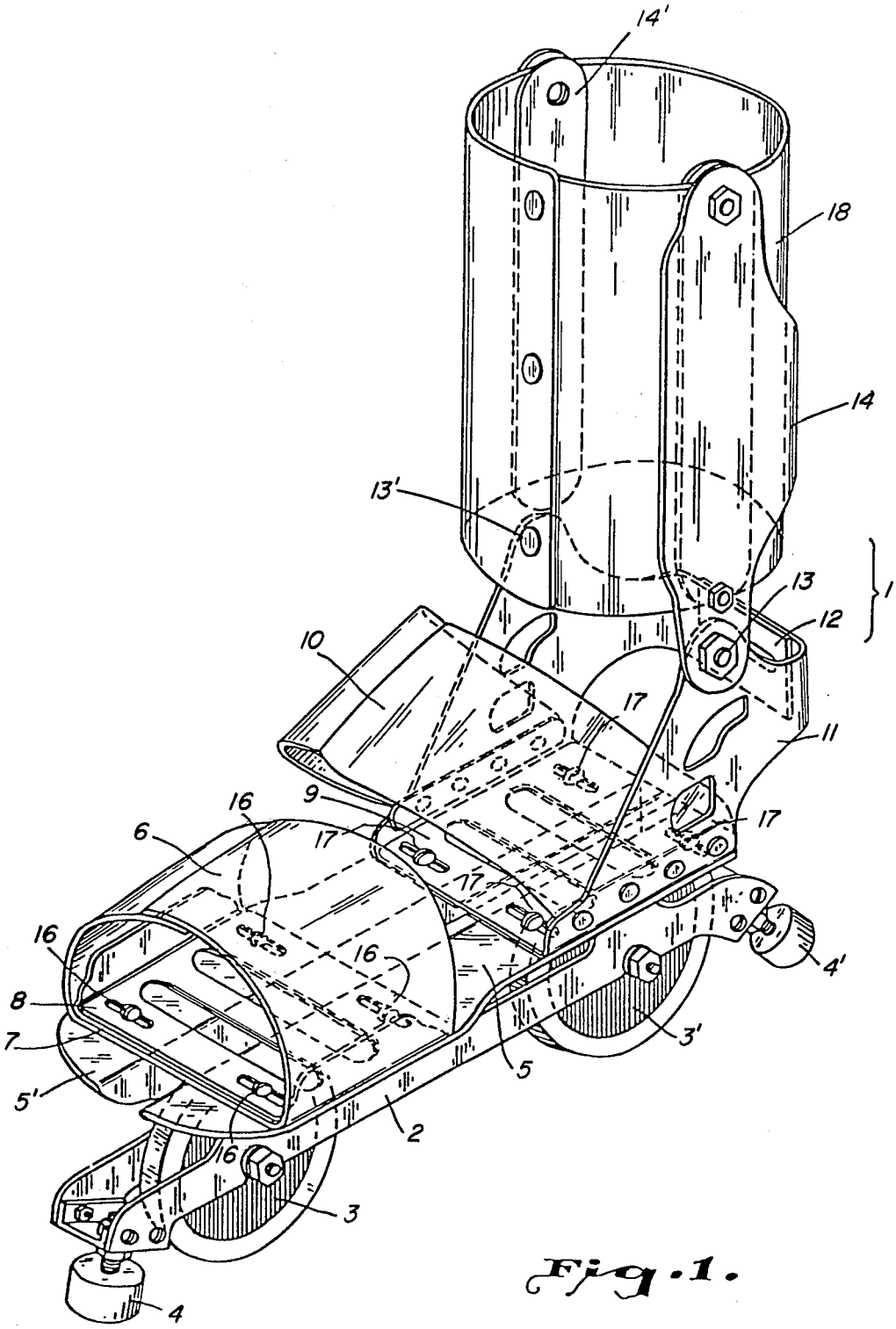
FIG. 1 is an isometrical drawing showing the single tract skate completely assembled.

Reference is made to the drawings. FIG. 1 shows the general features of the skate 1 including the undercarriage support member 2 forming a channel for the skate wheels 3 and 3' assembled in a straight alignment and for the front and rear adjustable brakes 4 and 4'.

Figure 2:
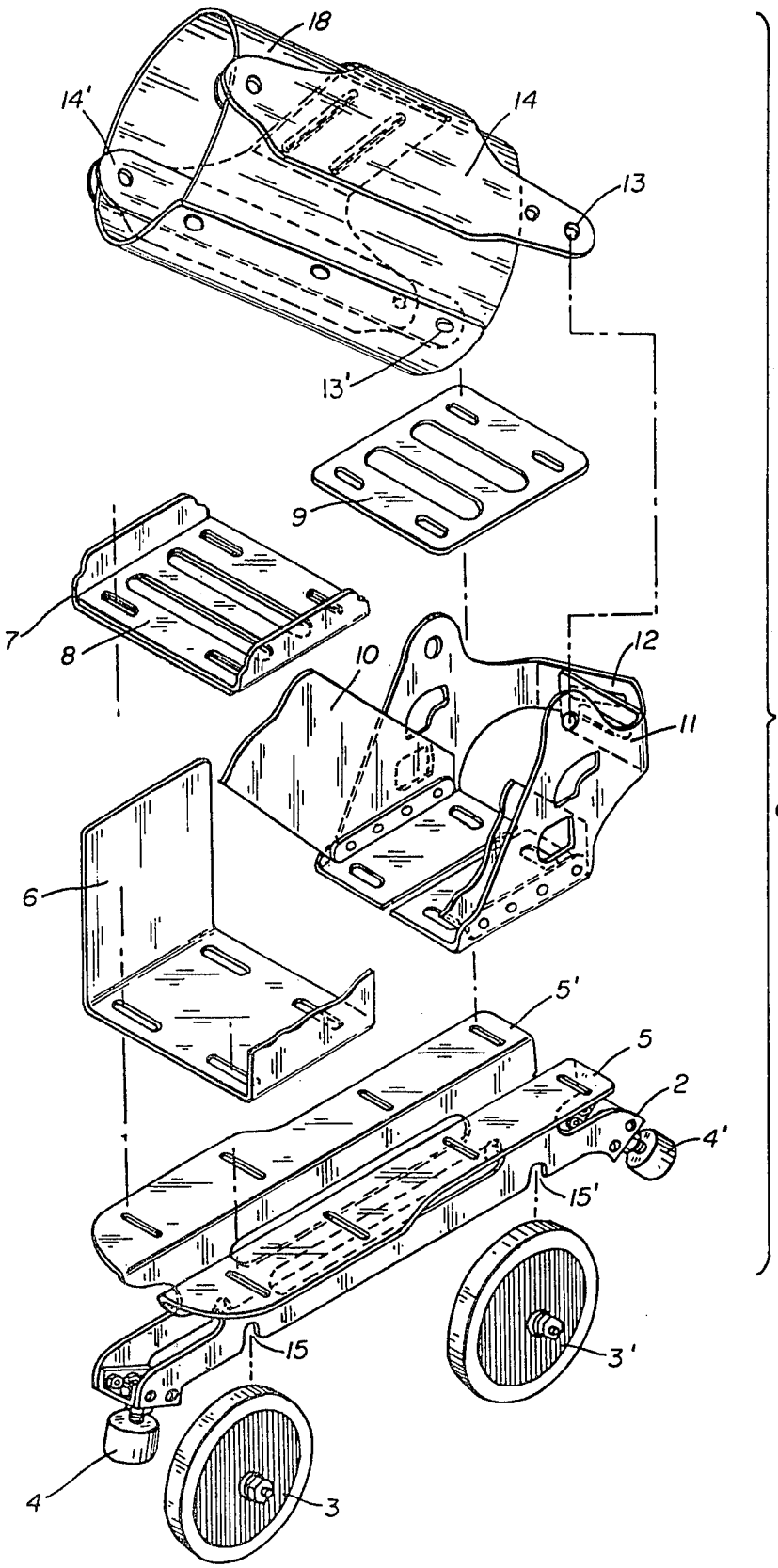
FIG. 2 is an isometrical drawing showing the component parts of the skate disassembled.

Reference is made to FIG. 2 which shows the skate 1 with its component parts. The wheels 3 and 3' fit into slots 15 and 15' shown in the undercarriage support member 2. The undercarriage support member 2 extends beyond the whole length of the upper slotted plate segments 5 and 5' of the skate. Adjustable brakes are shown at 4 and 4' extending past the ends of the upper plate segments 5 and 5' of the body of the skate 1.

Reference is made to FIG. 1 which shows the undercarriage support member 2 formed by extending downwardly the two aligned upper slotted plate segments 5 and 5' having horizontal portions which form a platform to support first, a pair of slotted plates 7 and 8 useful as a foot support and structural stabilizer for the skate and an adjustable rear bracket 11 with slotted plate 9, FIG. 2, and an adjustable upper member 12, FIG. 2. The bracket assembly 11 is useful as an additional structural stabilizer for the skate. Support strap 6 located at the front part of platform segments 5 and 5' is placed under the pair of slotted plates 7 and 8 which are then fastened firmly in place with bolts and nuts 16 to the plate segments 5 and 5'. Strap 10 is attached to bracket 11. To bracket 11 also is attached at 13 and 13' pivotly mounted extensions 14 and 14'. Extensions 14 and 14' are useful for securing the adjustable leg wrapper 18 and form a portion of the ankle support. Front adjustable slotted plates 7 and 8 and adjustable rear bracket 11 along with stabilizing plate 9 provide means for adjusting the position of the foot for better body balance. The straps 6 and 10 are made from reinforced nylon fabric, and straps 6 and 10 are provided with self-adhering webbing and buckles to secure the skate to the foot of the skater. The rear bracket 11 is adjustable at position 12 by moving the slotted plate 9 which laps over bracket 11, to bring the bracket 11 to the proper size for the heel which it supports. The lower section at the base of bracket 11 is attached to the rear platform by four screw bolts 17 and is adjustable inwardly and outwardly at position 12; this enables additional braking support for both the heel and the ankle. Leg wrapper 18 is mounted between the ankle support extensions 14 and 14' and is also made of reinforced nylon wrapping with a self-adhering binder and adjustable buckles to hold it in place.

One important feature of this skate 1 is the positioning of the rear bracket 11. The positioning is such that the alignment of the leg ankle support member 14 and 14' is located behind the rear axle of the skate. This feature improves the balance of the skater's body while in motion.

Although I have described only a typical preferred form and application of my invention, the invention should not be limited or restricted to specific details herein set forth, but I wish to reserve to myself any variations that may fall into the scope of the following claims.

I claim:

1. A single tract roller skate comprising, (a) a platform formed from two aligned slotted plate segments having horizontal portions, the said segments extending downwardly and being joined together to form an undercarriage support member having two slots for mounting a front and a rear roller wheel on axles, the said roller wheel axles being directly mounted in the said slots of the said undercarriage, the said platform being slotted in the front part of the said horizontal portion to provide means to fasten (b) a pair of slotted adjustable plates, slidably mounted on the front part of the said platform, the said plates being attached to each other respectfully, and to the said front part of the said platform by at least four screw bolts passing through at least four slotted sections in the said slotted adjustable plates and through four slotted sections in the said front part of the said platform, the said adjustable plates being positioned on the said platform so as to slide inwardly and outwardly across the said front part of the said platform, the said adjustable plates having a foot support strap positioned between the said front part of the said platform and under the said pair of the said adjustable plates, (c) an adjustable rear bracket mounted on the rear surface of the said platform having a base and an upper section, the said base section of said adjustable rear bracket having an adjustable plate mounted on the said base section, the said base section and the said adjustable plate each having slotted sections aligned with four slotted sections located in the said rear surface of the said platform, the said adjustable plate and the said base section of the said adjustable rear bracket both being attached to the said rear surface of the said platform by four screwbolts, the said upper section of the said rear bracket having two adjustable slotted segments lapped over each other to adjust the opening of the said upper section of the said rear bracket, the said rear bracket being adjustable inwardly and outwardly, the said rear bracket having a pair of strap webbing attached thereto with means to secure the said strap webbing in a closed curve.

2. The said single roller skate as claimed in claim 1 wherein the said undercarriage is extended on both ends beyond the said skate platform, the said ends of the said undercarriage having bracket means for mounting a first and a second adjustable brake.

3. The single track skate as claimed in claim 2 where the said adjustable rear bracket mounted on the surface of the said platform extends upwardly with pivot means, the said pivot means being useful for attaching a pair of bracket extensions which are aligned to the rear of the rear axle of the roller wheels, the said bracket extensions having attached thereto webbing suitable for encircling the calf of the skater's leg.

* * * * *